United States Patent [19]

Lonergan

[11] Patent Number: 4,841,219

[45] Date of Patent: Jun. 20, 1989

[54] LOSSLESS OVERCURRENT SENSING CIRCUIT FOR VOLTAGE REGULATOR

[75] Inventor: Kevin J. Lonergan, Palmer Lake, Colo.

[73] Assignee: Digital Equipment Corporation, Maynard, Mass.

[21] Appl. No.: 192,686

[22] Filed: May 10, 1988

[51] Int. Cl.[4] ..... G05F 1/44

[52] U.S. Cl. ..... 323/274; 323/277

[58] Field of Search ..... 323/273, 274, 275, 276, 323/277, 280; 361/18

[56] References Cited

U.S. PATENT DOCUMENTS 4,176,309 11/1979 Schulz et al. ..... 323/277

4,254,372 3/1981 Moore, Jr. ..... 323/277

*Primary Examiner*—Peter S. Wong

*Attorney, Agent, or Firm*—Jones, Tullar & Cooper

[57] ABSTRACT

An overcurrent sensing circuit for use with a voltage regulator, such as a linear post regulator for a power supply, utilizes a field effect transistor (FET) both as the pass element for the voltage regulator, and as a current sense resistor. The output voltage from the FET is fed back to an input of a differential amplifier, which generates a control voltage for the gate of the FET, so that the output voltage will remain constant. If an overcurrent condition occurs through the FET, the control voltage will exceed a set point, thus driving the FET into saturation, and sensing circuitry will generate an overcurrent output that can be utilized to shut off the regulator. A single sensing circuit can be used for multiple regulators if desired.

5 Claims, 3 Drawing Sheets

LOSSLESS OVERCURRENT SENSING CIRCUIT FOR VOLTAGE REGULATOR

BACKGROUND OF THE INVENTION

The present invention relates, in general, to an overcurrent sensing circuit for use with a voltage regulator, such as a linear post regulator for a power supply.

In conventional voltage regulators, overcurrent protection is usually achieved by inserting a sense resistor into the current path of the regulator. Current flowing through this resistor develops a voltage which is proportional to the current by virtue of Ohm's law. This voltage is measured and compared to a reference voltage, and when the reference voltage level is exceeded, the current to the regulator is cut off, or otherwise inhibited, such that no damage occurs thereto.

A drawback to this type of overcurrent sensor, is that the current sense resistor introduces a power loss in the regulator circuit that reduces the circuit's efficiency. In addition, the sense resistor adds an additional element to the circuit, and increases the physical size of the regulator. This is of further significance in systems which employ a plurality of voltage regulators, such as a multiple output power supply.

SUMMARY OF THE INVENTION

It is therefore the object of the present invention to provide an overcurrent sensing circuit for a voltage regulator, or the like, which employs a minimum of circuit elements, and introduces minimal power losses to the regulator circuit.

This, and other, objects of the invention are achieved by utilizing a field effect transistor (FET) as both the pass element for the voltage regulator, and as a sense resistor for an overcurrent sensing circuit. The input to the voltage regulator is connected to the drain of the FET, while the output is connected to its source. The output voltage is fed back to one of the inputs of an error amplifier where it is compared to a reference voltage. The output of the error amplifier is connected to the gate of the FET to control the current flow therethrough. If the output voltage drops too low, the error amplifier output will act to turn the FET on harder to bring the output voltage back into regulation. Conversely, if the output voltage rises too high, the error amplifier will reduce the FET gate voltage to thereby reduce the FET's output voltage.

The output of the error amplifier can also be monitored to indicate when an overcurrent condition exists. If for example, the output of the regulator is short circuited, and the output voltage drops to zero, the error amplifier will quickly generate its maximum voltage in an attempt to turn the FET on even harder to bring the output voltage back up to normal. When this happens, a Zener diode, which is also connected to the output of the error amplifier, will conduct current to an overcurrent indicating circuit, the output of which can be used in any suitable manner to shut off the regulator.

In the circuit, no current sense resistor is needed, since the FET pass element acts as a current sense resistor itself. When it is driven into saturation by an overcurrent condition, it essentially becomes a fixed resistor between the input and the output of the regulator. Overcurrent is indicated by detection of the abnormally high gate voltage needed to cause saturation. This circuit is thus advantageous in that it saves the cost and space required for a sense resistor, and also eliminates power losses generated by a separate sense resistor.

BRIEF DESCRIPTION OF THE DRAWINGS

The foregoing and additional objects, features, and advantages, of the present invention will become apparent from the following detailed description thereof, taken in conjunction with accompanying drawings, in which.

DETAILED DESCRIPTION OF THE PREFERRED EMBODIMENT

Figure 1:
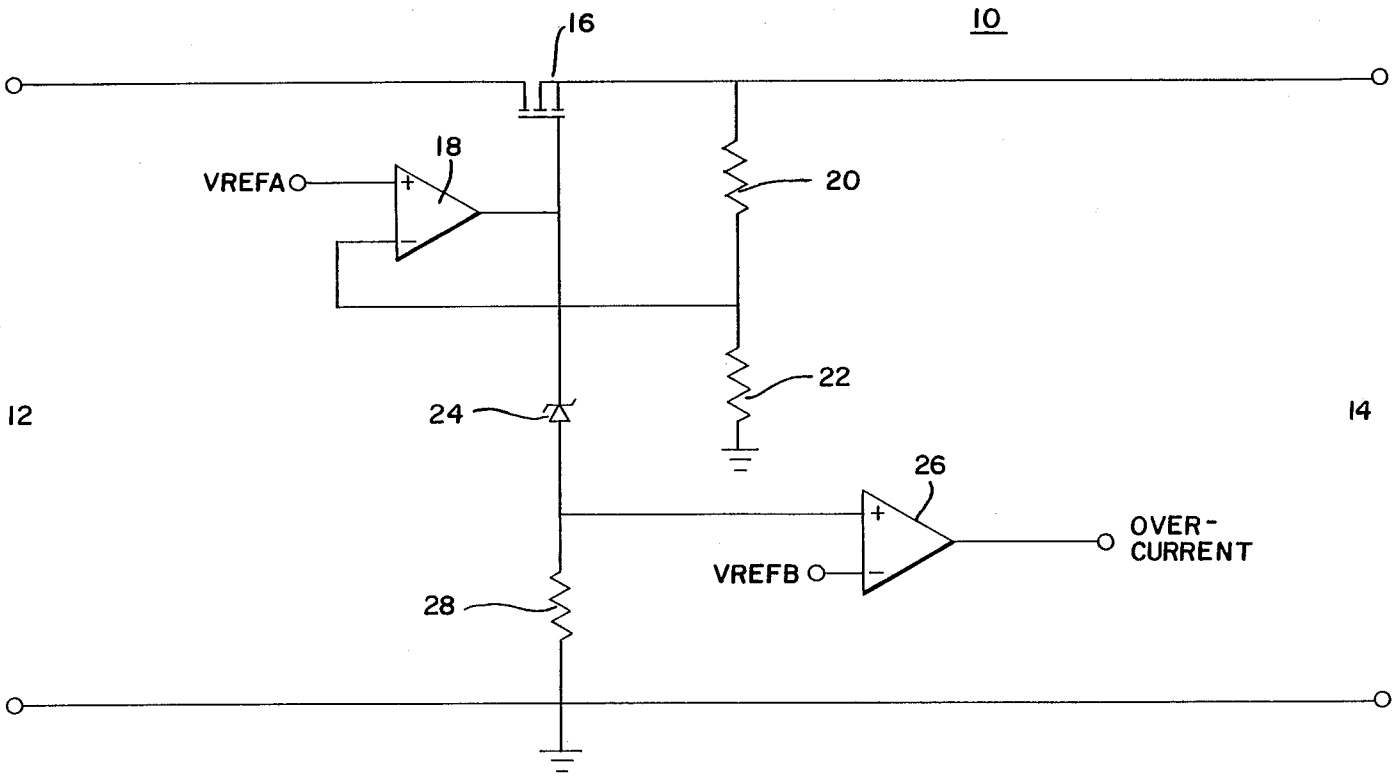
FIG. 1 is a schematic diagram of a basic voltage regulator circuit which employs the overcurrent sensing circuitry of the present invention.

Turning now to a more detailed consideration of the present invention, there is illustrated in FIG. 1, a voltage regulator circuit 10 that includes an unregulated input 12, and a regulated output 14. Disposed between input 12 and output 14 is a FET 16 that acts as a pass element, with its drain connected to input 12 and its source connected to output 14.

Output 14 is connected to the negative input of a differential error amplifier 18. A resistor 20 is disposed between output 14 and amplifier 18, and another resistor 22 is connected at one end between amplifier 18 and resistor 20, and at a second end to ground. Resistors 20 and 22 can be selected as desired to control the proportion of the output voltage which appears on the negative input of amplifier 18. A reference voltage VREFA is fed to the positive input of the error amplifier 18.

The output of amplifier 18 is connected to the gate of FET 16, and to the cathode of a Zener diode 24. The anode of Zener diode 24 is fed to a positive input of a comparator 26, and through a resistor 28 to ground. A reference voltage VREFB is fed to the negative input of comparator 26. Comparator 26 generates an output which can be connected to any suitable device to either indicate an overcurrent condition, or to disconnect or otherwise shut down regulator 10.

In the operation of regulator circuit 10, FET 16 serves to maintain the voltage on output 14 at a relatively constant level in spite of variations in the voltage at input 12. As an example, suppose the output voltage is to be maintained at a level of 5 volts. Then, the values of resistors 20 and 22, and VREFA, are chosen so that if the output voltage drops below 5 volts, the output voltage from error amplifier 18 will increase, and cause FET 16 to be turned on more, thus bringing the output voltage back up to 5 volts. Conversely, if the output voltage increases above 5 volts, the output voltage from error amplifier 18 will decrease and begin to turn FET 16 off, thereby decreasing the output voltage back to 5 volts.

Now suppose an overcurrent condition occurs that is due, for example, to a short circuit in output 14. This will cause the output voltage to drop to zero, thus causing the voltage on the negative input to error amplifier 18 to also drop to zero. Error amplifier 18 will immediately attempt to compensate for this by turning FET 16 on harder. Since this will have no effect on the output voltage, however, error amplifier 18 will quickly supply its maximum voltage to the gate of FET 16, and drive it into saturation.

Figure 2:
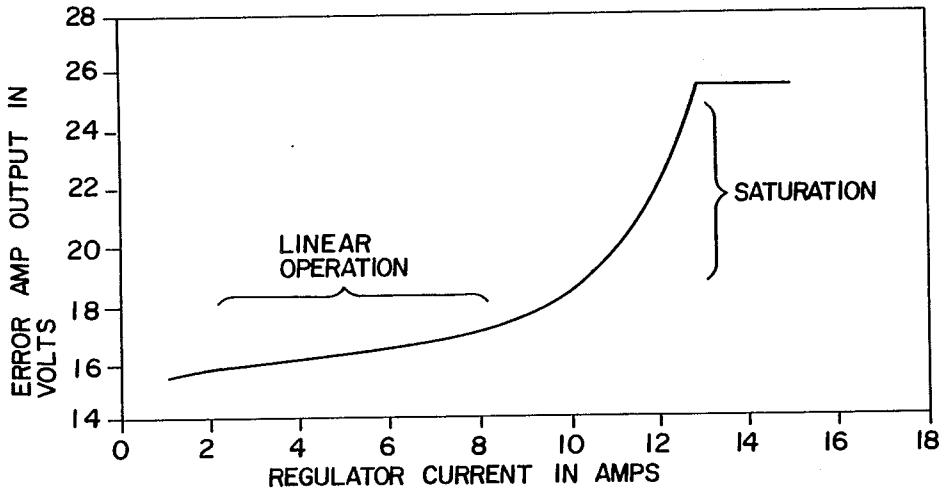
FIG. 2 is a graphical illustration of the voltage characteristics of an error amplifier as a function of regulator current, and, FIG. 3 is a schematic circuit diagram illustrating the present invention as employed in a multiple voltage regulator system.

The maximum voltage that can be generated by error amplifier 18 depends on its supply voltage. By way of example, and as illustrated in the graph in FIG. 2, the maximum output voltage of error amplifier 18 is selected to be approximately 25 volts. As can be seen from the graph, FET 16 operates linearly until the regulator current increases above approximately 10 amps. At this point, the output from error amplifier 18 exceeds approximately 18 volts, and begins to drive FET 16 into saturation.

If the breakdown voltage of Zener diode 24 is properly chosen, current can be supplied to the positive input of comparator 26 when FET 16 is driven into saturation. In the example illustrated in FIG. 2, the breakdown voltage of diode 24 is chosen to be 18 volts so that anytime the output voltage of error amplifier 18 exceeds 18 volts, diode 24 will conduct current to comparator 26. When the voltage on the positive input of comparator 26 exceeds VREFB, which is preferably chosen to be relatively low such as 0.5 volts, an output will be generated by comparator 26. This can be utilized to indicate the overcurrent condition, and control suitable circuitry (not shown) to either disconnect power from regulator circuit 10, or to otherwise correct the overcurrent condition.

Figure 3:
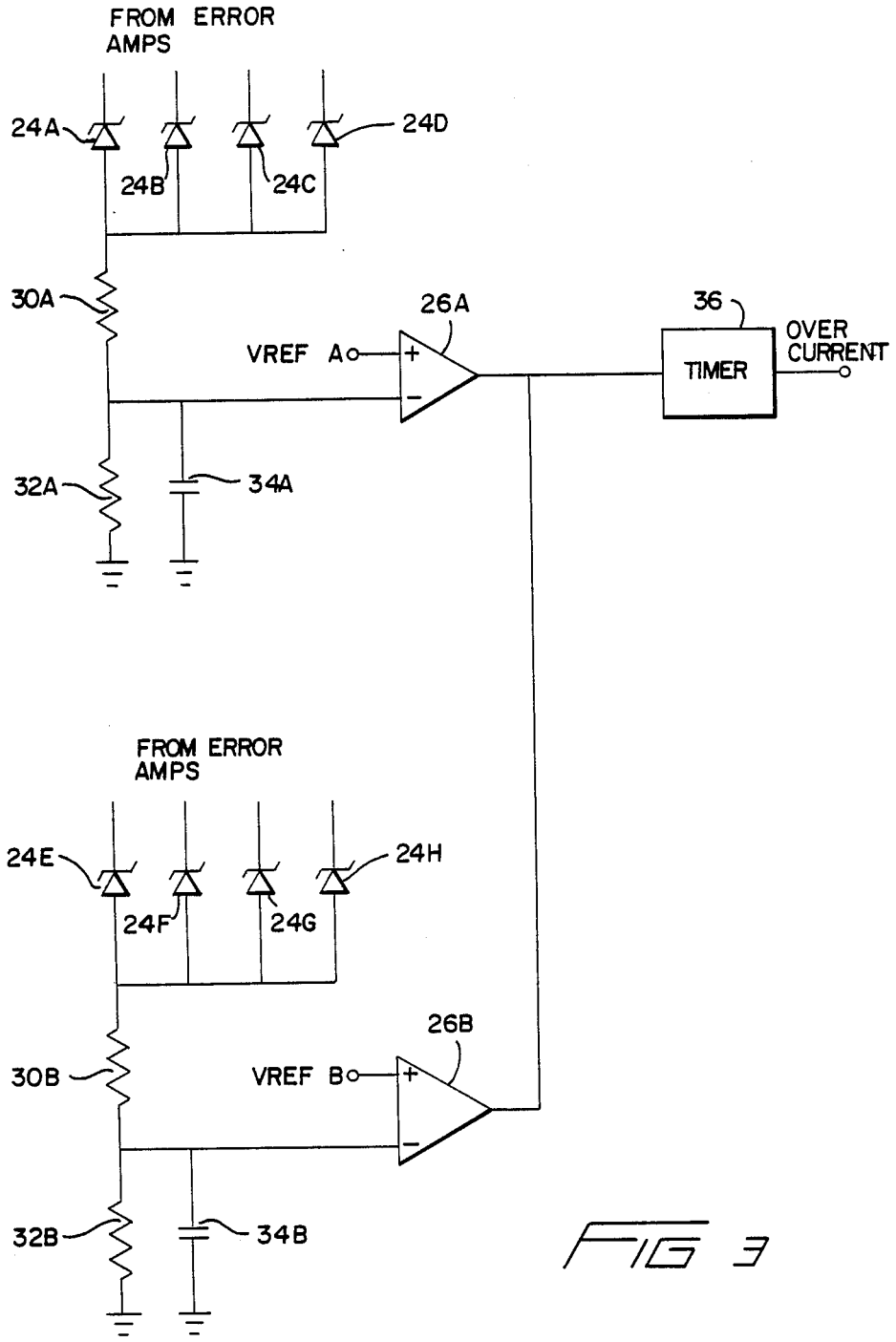

Turning now to FIG. 3, there is illustrated an overcurrent sensing circuit that can be utilized with a plurality of voltage regulators like the one illustrated in FIG. 1. More specifically, there is shown a first group of Zener diodes 24 A–D which receive the voltage outputs from the plurality of corresponding voltage regulator error amplifiers (not shown). The outputs from Zener diodes 24 A–D are connected together, and are fed through a resistor 30A to the negative input of a first comparator 26A. Another resistor 32A and a transient protection capacitor 24A provide a path to ground from a point between resistor 30A and comparator 26A. As with the circuit illustrated in FIG. 1, a voltage reference VREFA is supplied to the positive input of comparator 26A, and is selected so that comparator 26A provides an output whenever one of the Zener diodes 24A–24D begins to conduct due to an overcurrent condition in their corresponding voltage regulator.

A second group of Zener diodes 24E–H are also provided which receive voltage from the error amplifiers of a second group of voltage regulators. Like the outputs of Zener diodes 24A–D, the outputs from Zener diodes 24E–H are connected together, and are fed through a resistor 30B to the negative input of a second voltage comparator 26B. Also, a resistor 32B and a capacitor 34B are provided which correspond to resistor 32A and capacitor 34A described above. A voltage reference VREFB is provided to the positive input of comparator 26B.

The values of the various circuit elements shown in FIG. 3 can be chosen, for example, so that Zener diodes 24A–D are connected to voltage regulators that are set at a first voltage (e.g. 12 volts), and Zener diodes 24E–H are connected to voltage regulators that are set at a second voltage (e.g. 5 volts). The outputs from voltage comparators 26A and 26B are connected together and fed through a timer circuit 36. Timer 36 can be any conventional circuit that provides an output for a set period of time (e.g. 2 seconds) when a signal is received from either comparator 26A or 26B. After the set time period, timer 36 can automatically be reset and stop generating an output. In this manner, transient or temporary current surges through any of the voltage regulators will only cause a temporary overcurrent output so that the regulators can be switched back on once the overcurrent condition is removed.

From the foregoing, it is apparent that the present invention provides an overcurrent sensing circuit which eliminates the need for sensing resistors, and is designed so that a single voltage comparator can be utilized to generate an output for a plurality of overcurrent sensing circuits. Although the invention has been disclosed in terms of a preferred embodiment, it should be understood that numerous variations and modifications could be made without departing from the true spirit and scope of the inventive concept as set forth in the following claims.

What is claimed is:

1. An overcurrent sensing circuit for voltage regulators comprising:

at least a first voltage regulator circuit including:

(a) an input;

(b) an output;

(c) a field effect transistor having a source, a drain, and a gate, and being disposed between said input and said output so that current can flow from said input through the drain and the source to said output; and, (d) voltage feedback means connected between said output and a first input of an amplifier circuit, said amplifier circuit generating as an output, a control voltage that is fed to the gate of the field effect transistor, said control voltage being responsive to the circuit output voltage; and, means to sense when the magnitude of said control voltage exceeds a set point at which said field effect transistor is driven into saturation thereby, said point being indicative of an overcurrent condition between said input and said output.

2. The overcurrent sensing circuit of claim 1, wherein said means to sense when the magnitude of said control voltage exceeds a set point comprises:

a Zener diode having a cathode connected to the control voltage output of said amplifier circuit, and chosen so that it begins to conduct current when the diode voltage exceeds said set point; and, means to sense when current flows through said Zener diode.

3. The overcurrent sensing circuit of claim 2, wherein said means to sense when current flows through said Zener diode comprises a comparator amplifier having a first input connected to an anode of said Zener diode; a second input connected to a reference voltage; and, an output which generates a voltage when the voltage at the first input exceeds the voltage of the second input.

4. The overcurrent sensing circuit of claim 3, further comprising:

at least a second voltage regulator circuit including:

at least a second Zener diode having a cathode connected to a control voltage output of a second amplifier circuit; and an anode also connected to said first input of said comparator amplifier;

whereby, a voltage output will be generated by said comparator amplifier is current flows through any one of said Zener diodes.

5. The overcurrent sensing circuit of claim 3 further including a timing circuit having an input connected to the output of said comparator amplifier which generates a voltage output for a set period of time when a voltage is generated at the output of said comparator amplifier.

* * * * *